US007631724B2

(12) United States Patent
Onishi

(10) Patent No.: US 7,631,724 B2
(45) Date of Patent: Dec. 15, 2009

(54) SOUND-WAVE PATH-LENGTH CORRECTING STRUCTURE FOR SPEAKER SYSTEM

(75) Inventor: Masatake Onishi, Yokohama (JP)

(73) Assignee: Victor Company of Japan, Limited, Yokohama-shi (JP)

( * ) Notice: Subject to any disclaimer, the term of this patent is extended or adjusted under 35 U.S.C. 154(b) by 0 days.

(21) Appl. No.: 12/081,806

(22) Filed: Apr. 22, 2008

(65) Prior Publication Data

US 2008/0264717 A1 Oct. 30, 2008

(30) Foreign Application Priority Data

Apr. 27, 2007 (JP) ..... 2007-118550

(51) Int. Cl.

| | |
|---|---|
| ***G10K 11/08*** | (2006.01) |
| ***H04R 1/30*** | (2006.01) |
| *G10K 11/02* | (2006.01) |
| *H04R 1/22* | (2006.01) |

(52) U.S. Cl. ..... 181/192; 181/185; 381/340

(58) Field of Classification Search ..... 181/192, 181/185, 187, 159, 152; 381/339, 340
See application file for complete search history.

(56) References Cited

U.S. PATENT DOCUMENTS

| | | | | |
|---|---|---|---|---|
| 1,174,358 | A * | 3/1916 | Sexton | 181/185 |
| 1,311,478 | A * | 7/1919 | Willson | 181/192 |
| 1,314,980 | A * | 9/1919 | Pogonowski | 181/192 |
| 1,390,238 | A * | 9/1921 | Owen | 181/187 |
| 1,849,840 | A * | 3/1932 | Kellogg | 181/187 |
| 1,992,268 | A * | 2/1935 | Wente | 181/187 |
| 2,001,089 | A * | 5/1935 | Blattner | 181/187 |
| 2,897,292 | A * | 7/1959 | Van Den Bosch | 381/341 |
| 3,303,904 | A * | 2/1967 | Kelly | 181/176 |
| 3,668,335 | A * | 6/1972 | Beveridge | 381/336 |
| 3,957,134 | A * | 5/1976 | Daniel | 181/176 |
| 3,972,385 | A * | 8/1976 | Hino et al. | 181/192 |
| 3,980,829 | A * | 9/1976 | Beveridge | 381/305 |
| 4,171,734 | A * | 10/1979 | Peveto et al. | 181/192 |

(Continued)

FOREIGN PATENT DOCUMENTS

| | | |
|---|---|---|
| JP | 2004/086812 | 7/2004 |

(Continued)

*Primary Examiner*—Edgardo San Martin
(74) *Attorney, Agent, or Firm*—The Nath Law Group; Jerald L. Meyer; Jonathan A. Kidney

(57) ABSTRACT

A sound-wave path-length correcting structure for a speaker system includes a sound source and a horn. The horn has a sound-wave path-length correcting throat portion. The sound-wave path-length correcting throat portion corrects a sound-wave path-length of a sound wave input from an inlet opening thereof in the sound path, and emits the sound wave from an outlet opening thereof. The sound path is defined by a first side surface with a concave curved surface and a second side surface with a convex curved surface that face each other with a space, and a third side surface and a fourth side surface that face each other with a space. The third side surface and the fourth side surface are formed so that their surfaces gradually widen as the surfaces advance from the inlet opening to the outlet opening of the sound-wave path-length correcting throat portion.

15 Claims, 12 Drawing Sheets

U.S. PATENT DOCUMENTS 4,369,857 A * 1/1983 Frazer et al. ..... 181/159
5,163,167 A * 11/1992 Heil ..... 181/152
5,524,062 A * 6/1996 Oh ..... 381/338
5,900,593 A * 5/1999 Adamson ..... 181/152
6,035,051 A * 3/2000 Sato ..... 381/340
6,581,719 B2 * 6/2003 Adamson ..... 181/182
6,585,077 B2 * 7/2003 Vincenot et al. ..... 181/192
6,668,969 B2 * 12/2003 Meyer et al. ..... 181/177
6,868,937 B2 * 3/2005 Cass ..... 181/192
7,044,265 B2 * 5/2006 Murphy ..... 181/192
7,268,467 B2 * 9/2007 De Vries ..... 310/328

FOREIGN PATENT DOCUMENTS

JP 2008278192 A * 11/2008

* cited by examiner

HYPERBOLIC PORTION BETWEEN A AND B IS USED
FOCUS POINT
X
SL
Y
A
0
B
FOCUS POINT 13
13d
13e
13b
13f
OUTLET OPENING
13c
13g 13
13b
A
13g
13e
CO
13f
13a
A
INLET OPENING 13a 13
13R 13L
13d 13d
13R
13L
13

LENGTH OF HYPERBOLIC CURVE SL
ENDING POINT FOR CORRECTION
CENTER AXIS CO
13b
SECOND ARC LENGTH RL
13d
13g
13c
FIRST ARC LENGTH RL
STARTING POINT FOR CORRECTION
13a
Y
X

SOUND-WAVE PATH-LENGTH CORRECTING STRUCTURE FOR SPEAKER SYSTEM

BACKGROUND OF THE INVENTION

1. Field of the Invention

The present invention relates to a sound-wave path-length correcting structure for a speaker system which includes a sound source and a horn having a throat portion and a horn portion. More specifically, the present invention relates to a sound-wave path-length correcting structure for a speaker system which is configured to receive a sound wave output from the sound source through an inlet opening of the throat portion, correct a sound-wave path-length in a sound path of the throat portion, and emit the sound wave from an outlet opening of the throat portion to the horn portion.

2. Related Background of the Invention

When efficiently amplifying sound waves output from a sound source such as a speaker, since a direct vibration of air causes a low resistance, a horn with a megaphone structure is generally connected to a sound wave output opening of the sound source.

FIG. 1 is a view illustrating schematically a general horn speaker. In the general horn speaker shown in FIG. 1, in a structure where a horn h with the megaphone structure is connected to a sound source o such as a speaker, a sound wave received through an inlet opening of the horn h is passed through a sound path r which is formed in the horn h, and then the sound wave is emitted from an outlet opening of the horn h.

In this case, in the horn h, the sound path r is formed such that the relation of lengths of sound-wave paths oa, ob, oc, od, oe, of and og of the sound wave, which passes through the inside of sound path r, becomes oa<ob<oc<od<oe<of<og. Thus, the sound wave has a wave surface w in the same phase and the concentric circular shape which centers on the sound source o that becomes a point sound source. However, if the wave surface w has the concentric circular shape, a sound pressure attenuates in accordance with the distance from the sound source o to an audience.

In order to avoid the attenuation of sound pressure caused in a case where the wave surface of the sound wave, which is emitted from a general horn speaker to the outside, has the concentric circular shape, a sound wave guiding structure for a speaker system has been provided (e.g. refer to Japanese SAIKOHYO No. 2004-086812). In the sound wave guiding structure for a speaker system, a sound path in a throat portion is branched into plural branched paths with a plurality of stages. In a structure where a horn with this throat portion and a horn portion is connected to the sound wave output opening of the sound source such as a speaker, when a sound wave is emitted from an outlet opening of the throat portion to the horn portion after the sound wave output from the sound wave output opening of the sound source is received through an inlet opening of the throat portion and then a sound-wave path-length is corrected in each of branched paths of the throat portion, a wave surface in the same phase of the sound wave emitted from the throat portion to the horn portion has any of a flat rectangular plane-like shape, a convex curve-like shape, and a concave curve-like shape, with respect to an emission direction of the sound wave.

FIGS. 2A to 2C are longitudinal sectional views of throat portions of horn speakers with various shapes of sound paths in the conventional sound wave-guiding structures for a speaker system. The conventional sound wave-guiding structures for a speaker system shown in FIGS. 2A to 2C are disclosed in Japanese SAIKOHYO No. 2004-086812.

In the conventional sound wave-guiding structures for a speaker system shown in FIGS. 2A to 2C, each of horn speakers 100A, 100B and 100C includes a speaker (not shown) as the sound source, a throat portion 110 connected to the speaker, and a horn portion 120 integrally connected to the throat portion 110, in which each throat portion 110 and each horn portion 120 are formed in vertically symmetrical shapes.

In order to attach the speakers to the base end portions of the throat portions 110, 110 and 110 of the horn speakers 100A, 100B and 100C respectively, flanges 111A, 111B and 111C are provided to the phone speakers 100A, 100B and 100C respectively. Inlet openings 112A, 112B and 112C are formed near the flanges 111A, 111B and 111C respectively. Rectangular and slit-like outlet openings 113A, 113B and 113C are formed at the top ends of the throat portions 110, 110 and 110 respectively.

The sound path r is formed in the throat portion 110 from the base end portion to the top end of the respective throat portions 110 of the horn speakers 100A, 100B and 100C. The sound path r includes therein plural branched paths (D1: first branching point, D2 and D2: second branching points; D3, D3, D3 and D3: third branching points) that are branched to a plurality of stages (e.g. three stages in a tree shape) Thus, each of the outlet openings 113A, 113B, and 113C has eight outlets $t_1$ to $t_8$.

In the horn speaker 100A shown in FIG. 2A, all sound-wave path-lengths from the inlet opening 111A to all outlets $t_1$ to $t_8$ for the branched paths with a plurality of stages that are formed in the sound path r of the throat portion 110 are made equivalent. Thus, when the speaker attached to the flange 111A is driven, a sound wave is emitted from the outlet opening 113A in the same phase and a wave surface Wa of the emitted sound wave has a rectangular plane-like shape with respect to the emission direction of the sound wave.

In the horn speaker 100B shown in FIG. 2B, regarding the branched paths with a plurality of stages that are formed in the sound path r of the throat portion 110, a sound-wave path with an outlet nearer to the center of the outlet opening 113B is set to have a shorter sound-wave path-length. Thus, when the speaker attached to the flange 111B is driven, a sound wave is emitted from the outlet opening 113B in the same phase and a wave surface Wb of the emitted sound wave has a convex curved surface-like shape with respect to the emission direction of the sound wave.

In the horn speaker 100C shown in FIG. 2C, regarding the branched paths with a plurality of stages that are formed in the sound path r of the throat portion 110, a sound-wave path with an outlet nearer to the center of the outlet opening 113C is set to have a longer sound-wave path-length. Thus, when the speaker attached to the flange 111C is driven, a sound wave is emitted from the outlet opening 113C in the same phase and a wave surface Wc of the emitted sound wave has a concave curved surface-like shape with respect to the emission direction of the sound wave.

According to the conventional sound wave guiding structures for a speaker system, the wave surfaces Wa, Wb and Wc of the sound waves that are emitted from the outlet openings 113A, 113B and 113C respectively formed at the top ends of the throat portions 110, 110 and 110 can be controlled to desired shapes by the branched paths that have branched in the sound paths r, r and r of the throat portions 110, 110 and 110 into a plurality of stages in the throat portions 110, 110 and 110 of the horn speakers 100A, 100B and 100C. Thus, the curvatures and the directivity angles of the wave surfaces Wa, Wb and Wc of the sound waves can be controlled easily. However, the conventional sound wave guiding structures for a speaker system have the following problem.

In the conventional sound wave guiding structures for a speaker system, partition walls are needed when branching the sound path r of each of the throat portions 110, 110 and 110 of the horn speakers 100A, 100B and 100C into a plurality of stages to form the branched paths. Thus, the branch path structure with a plurality of stages provided in the sound path r becomes complex, which makes the speaker expensive. The opening ratios at the outlet openings 113A, 113B and 113C formed in the top ends of the throat portions 110, 110 and 110 respectively are lowered by the respective ratios corresponding to the end surfaces of the partition walls, which reduces efficiency of the speaker. Moreover, when the wavelength of the sound wave is short (high frequency), the sound waves that are emitted from the branched paths with a plurality of stages mutually interfere, which causes the sound waves with unequal sound pressure. In addition, when the size of the horn speakers 100A, 100B and 100C is made large, the branch path structure with a plurality of stages that is provided in the sound path r of each throat portion 110 has multiple branches and, as a result, becomes complex. On the other hand, when the size of the horn speakers 100A, 100B, and 100C is made small, it is impossible to form branches due to small space in the sound path r of each throat portion 110.

SUMMARY OF THE INVENTION

The object of the present invention is to provide a sound-wave path-length correcting structure for a speaker system capable of correcting a path-length of a sound wave in a sound path of a throat portion with a simple structure, without branching the sound path of the throat portion into plural branched paths with a plurality of stages, in processes of connecting a horn having this throat portion and a horn portion to a sound source such as a speaker; receiving a sound wave output from the sound source through an inlet opening of the throat portion; correcting the path-length of the sound wave in the sound path of the throat portion, and emitting the sound wave from an outlet opening of the throat portion to the horn portion.

In order to achieve the above object, the present invention provides a sound-wave path-length correcting structure for a speaker system, comprising: a sound source for outputting sound waves; and a horn having a sound-wave path-length correcting throat portion for correcting a sound-wave path-length of a sound wave input from an inlet opening thereof connected to the sound source in a sound path and emitting the sound wave from a rectangular outlet opening, and a loudspeaker horn portion for amplifying the sound wave emitted from the outlet opening, wherein: the sound path is defined by a first side surface with a concave curve and a second side surface with a convex curve which are positioned in the longitudinal direction of the outlet opening and face each other with a space, and a third side surface and a fourth side surface which are positioned in the short direction of the outlet opening and face each other with a space; and the third side surface and the fourth side surface are formed such that the surfaces gradually widen towards the outside as the surfaces advance from the inlet opening to the outlet opening.

In a preferred embodiment of the present invention, in the sound path, the wave surface of the sound wave emitted from the outlet opening toward the loudspeaker horn portion is made to have any of a flat rectangular shape, a convex curve shape, and a concave curve shape, with respect to the emission direction of the sound wave.

In a preferred embodiment of the present invention, in the sound-wave path-length correcting throat portion, a plurality of sound-wave path-length correction paths are set in the sound path along the longitudinal direction of the outlet opening; in a sound-wave path-length correction path that passes a center axis connecting the center of the inlet opening and the center in the longitudinal direction of the outlet opening, a starting point for correcting the sound-wave path-length set in the inlet opening side and an ending point for correcting the sound-wave path-length set in the outlet opening side are connected each other with a first arc, a predetermined function curve, and a second arc; and when a length of a curve between the starting point for correcting the sound-wave path-length and the ending point for correcting the sound-wave path-length in the sound-wave path-length correction path is set to a design basis sound-wave path-length, sound-wave path-lengths of the plurality of sound-wave path-length correction paths are equivalent to the design basis sound-wave path-length.

In a preferred embodiment of the present invention, in the sound-wave path-length correcting throat portion, a plurality of sound-wave path-length correction paths are set in the sound path along the longitudinal direction of the outlet opening; in a sound-wave path-length correction path that passes a center axis connecting the center of the inlet opening and the center in the longitudinal direction of the outlet opening, a starting point for correcting the sound-wave path-length set in the inlet opening side and an ending point for correcting the sound-wave path-length set in the outlet opening side are connected each other with a first arc, a predetermined function curve, and a second arc; and when a length of a curve between the starting point for correcting the sound-wave path-length and the ending point for correcting the sound-wave path-length in the sound-wave path-length correction path is set to a design basis sound-wave path-length, sound-wave path-lengths of the plurality of sound-wave path-length correction paths become gradually longer than the design basis sound-wave path-length, as the sound-wave path-lengths advance to the outer circumference in the longitudinal direction of the outlet opening.

In a preferred embodiment of the present invention, in the sound-wave path-length correcting throat portion, a plurality of sound-wave path-length correction paths are set in the sound path along the longitudinal direction of the outlet opening; in a sound-wave path-length correction path that passes on the center axis connecting the center of the inlet opening and the center in the longitudinal direction of the outlet opening, a starting point for correcting the sound-wave path-length that is set in the inlet opening side and an ending point for correcting the sound-wave path-length that is set in the outlet opening side are connected each other with a first arc, a predetermined function curve, and a second arc; and when a length of a curve between the starting point for correcting the sound-wave path-length and the ending point for correcting the sound-wave path-length in the sound-wave path-length correction path is set to a design basis sound-wave path-length, sound-wave path-lengths of the plurality of sound-wave path-length correction paths become gradually shorter than the design basis sound-wave path-length, as the sound-wave path-lengths advance to the outer circumference in the longitudinal direction of the outlet opening.

In a preferred embodiment of the present invention, the predetermined function curve is any of a hyperbolic curve, a sine curve, a cosine curve, a circular arc curve, a parabolic curve, an elliptic curve, a clothoid curve, a cycloid curve, a curve of the second or higher order, a common logarithm curve, a natural logarithm curve, and a catenary curve.

In a preferred embodiment of the present invention, a surface including a rim portion of the outlet opening is formed to be plane-like, convex curve-like, or concave curve-like.

In a preferred embodiment of the present invention, starting points for correcting the sound-wave path-length are set convex curve-like, plane-like, or concave curve-like.

According to the sound-wave path-length correcting structure for a speaker system of the present invention, the outlet opening is rectangular and the sound path is defined by a first side surface with a concave curved surface and a second surface with a convex curved surface that are positioned in the longitudinal direction of the outlet opening and face each other with a space, and a third side surface and a fourth side surface that are positioned in the short direction of the outlet opening and face each other with a space, in the throat portion for correcting the sound-wave path-length. Moreover, the third side surface and the fourth side surface are formed such that the surfaces gradually widen as the surfaces advance from the inlet opening to the outlet opening of the sound-wave path-length correcting throat portion.

In the sound path, the wave surface of the sound wave emitted from the outlet opening of the sound-wave path-length correcting throat portion is made to have any of a wave surface of rectangular plane-like shape flat to the emission direction of the sound wave, a wave surface of convex curve-like shape convexed to the emission direction of the sound wave, and a wave surface of concave curve-like shape concaved to the emission direction of the sound wave. Thus, the interference of the sound waves will not occur even when the wavelength of the sound wave is short (high frequency). Accordingly, the output sound wave has an equal sound pressure, and then it is possible to provide the sound-wave path-length correcting structure for a speaker system with a good performance.

A branch path structure with a plurality of stages is not formed in the sound path of the sound-wave path-length correcting throat portion, and thus, it is possible to make the sound path easily. Accordingly, even when the sound-wave path-length correcting throat portion is large, the inside of the sound path is not complex, and even when the sound-wave path-length correcting throat portion is small, it is unlikely that formation of the sound path is difficult due to space.

DESCRIPTION OF THE PREFERRED EMBODIMENTS

Hereinafter, an embodiment of the present invention will be described in detail referring to FIGS. 3 to 12C.

Figure 3:
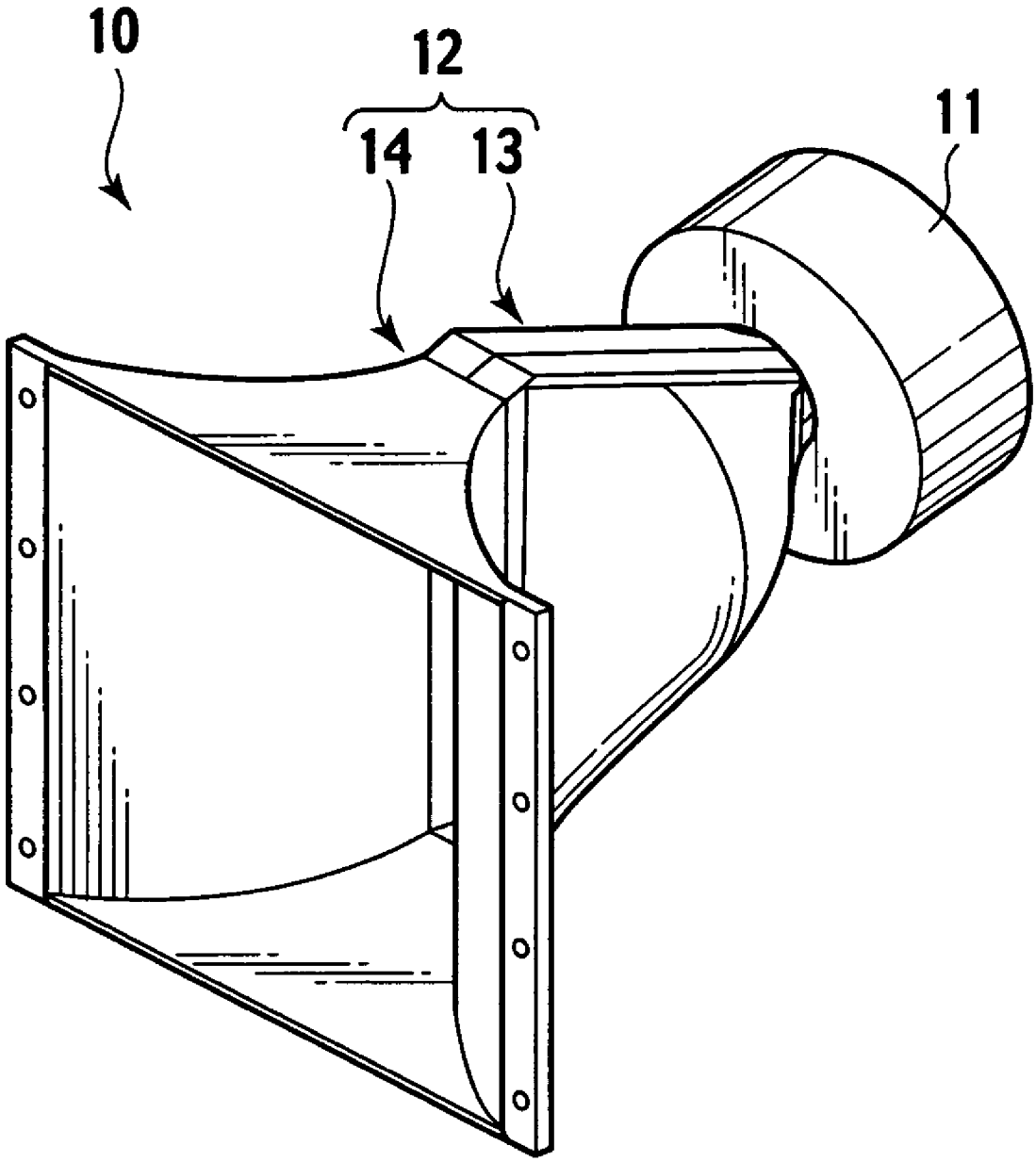
FIG. 3 is a perspective view illustrating a sound-wave path-length correcting structure for a speaker system according to an embodiment of the present invention.
Figure 4:
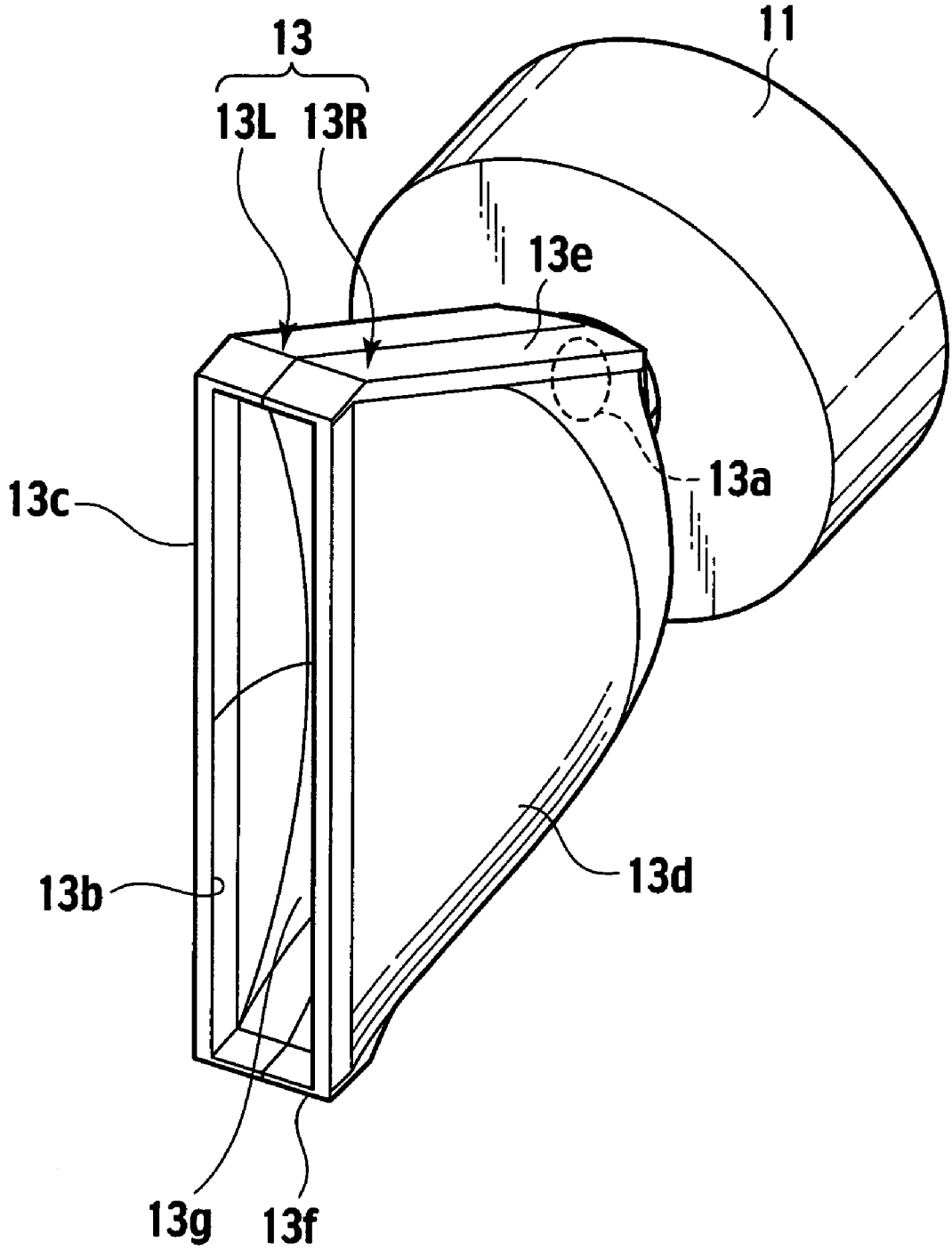
FIG. 4 is a perspective view illustrating a condition in which the sound-wave path-length correcting throat portion is connected to a speaker in the sound-wave path-length correcting structure for a speaker system according to the embodiment of the present invention.
Figure 5A:
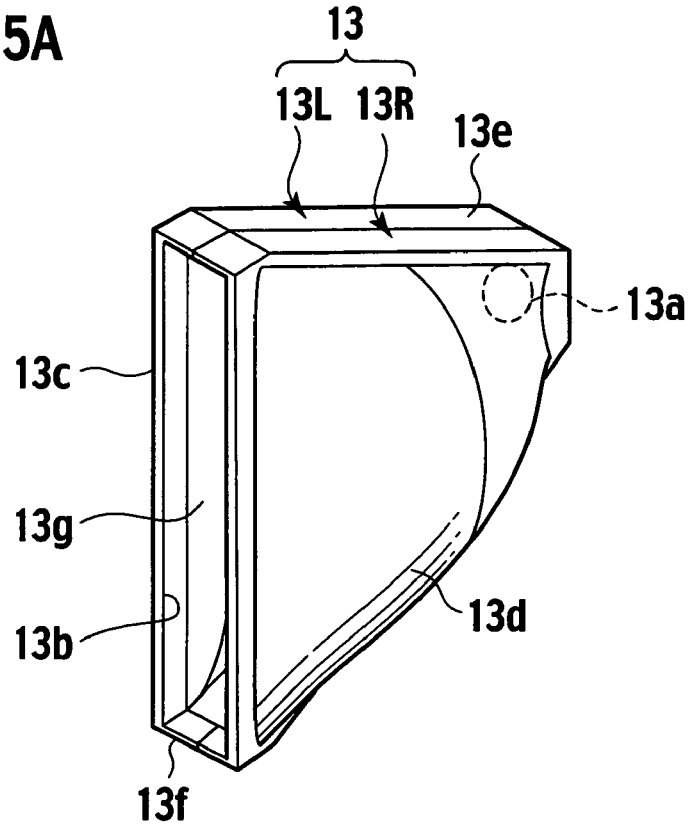
FIGS. 5A and 5B are perspective views respectively viewing the sound-wave path-length correcting throat portion from a right-surface side and a left-surface side thereof in the sound-wave path-length correcting structure for a speaker system according to the embodiment of the present invention.
Figure 5B:
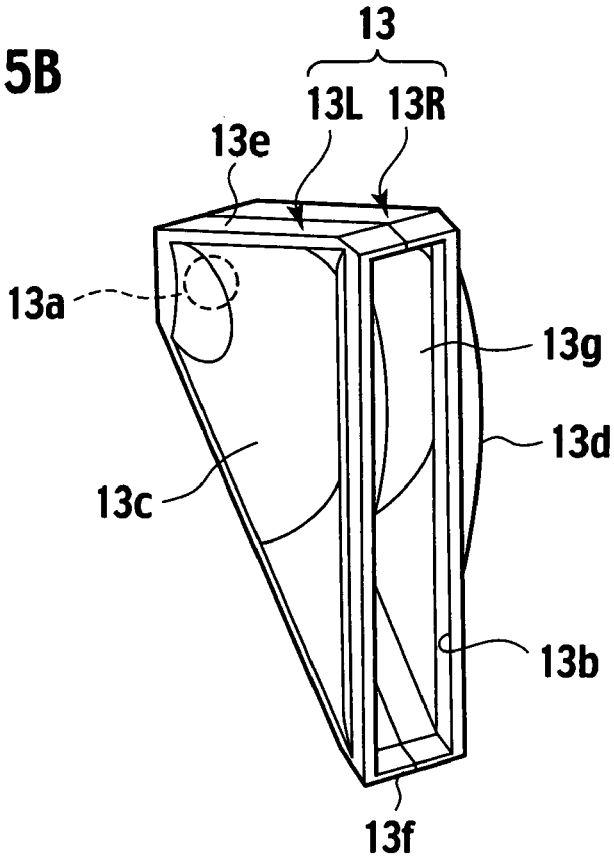

As shown in FIG. 3, a speaker system 10 to which a sound-wave path-length correcting structure for a speaker system according to the present invention is applied, includes a speaker 11 which is a sound source configured to output sound waves and a horn 12 which is connected to a sound-wave output opening (not shown) of the speaker 11. The speaker 11 functions as a tweeter driver.

The horn 12 has a sound-wave path-length correcting throat portion 13, which is connected to the sound-wave output opening of the speaker 11, for correcting the sound-wave path-length when receiving the sound wave output from the speaker 11; and a loudspeaker horn portion 14 with a megaphone structure, which is integrally connected to the sound-wave path-length correcting throat portion 13, for amplifying the sound wave emitted from the sound-wave path-length correcting throat portion 13 to the outside. The structure of the sound-wave path-length correcting throat portion 13 is a principal part of the present invention.

The structure of the sound-wave path-length correcting throat portion 13 will be described in detail referring to FIGS. 4 to 6F.

The sound-wave path-length correcting throat portion 13 is made of a resin material and divided into two of the left and right sides; a left side throat portion 13L and a right side throat portion 13R. The divided surfaces of the left and right throat portions 13L, 13R are fitted and integrally joined.

In the sound-wave path-length correcting throat portion 13, an inlet opening 13*a* is a small opening at the back end side, so as to match it with the sound wave outlet opening of the speaker 11. In contrast, an outlet opening 13*b* is a large rectangular-like opening at the top end side, so as to match it with an inlet opening (not shown) of a loudspeaker horn portion 14 (FIG. 3).

The sound-wave path-length correcting throat portion 13 is formed such that first and second side surfaces (left and right side surfaces) 13*c*, 13*d*, which correspond to the longitudinal direction of the rectangular outlet opening 13*b* and face each other with a space, are formed to be concave curved and convex curved respectively, and third and fourth side surfaces (top and bottom side surfaces) 13*e*, 13*f*, which correspond to the short direction of the rectangular outlet opening 13*b* and face each other with a space, widen gradually as the surfaces advance from the inlet opening 13*a* to the outlet opening 13*b*. A sound path 13*g* is enclosed by the first to fourth side surfaces 13*c* to 13*f* to be formed in the sound-wave path-length correcting throat portion 13.

A sound wave emitted from the sound wave output opening of the speaker 11 are received through the inlet opening 13*a* of the sound-wave path-length correcting throat portion 13, and thereafter, as described below, the sound-wave path-length is corrected in the sound path 13*g* and then emitted from the rectangular outlet opening 13*b* to the loudspeaker horn portion 14.

Figure 1:
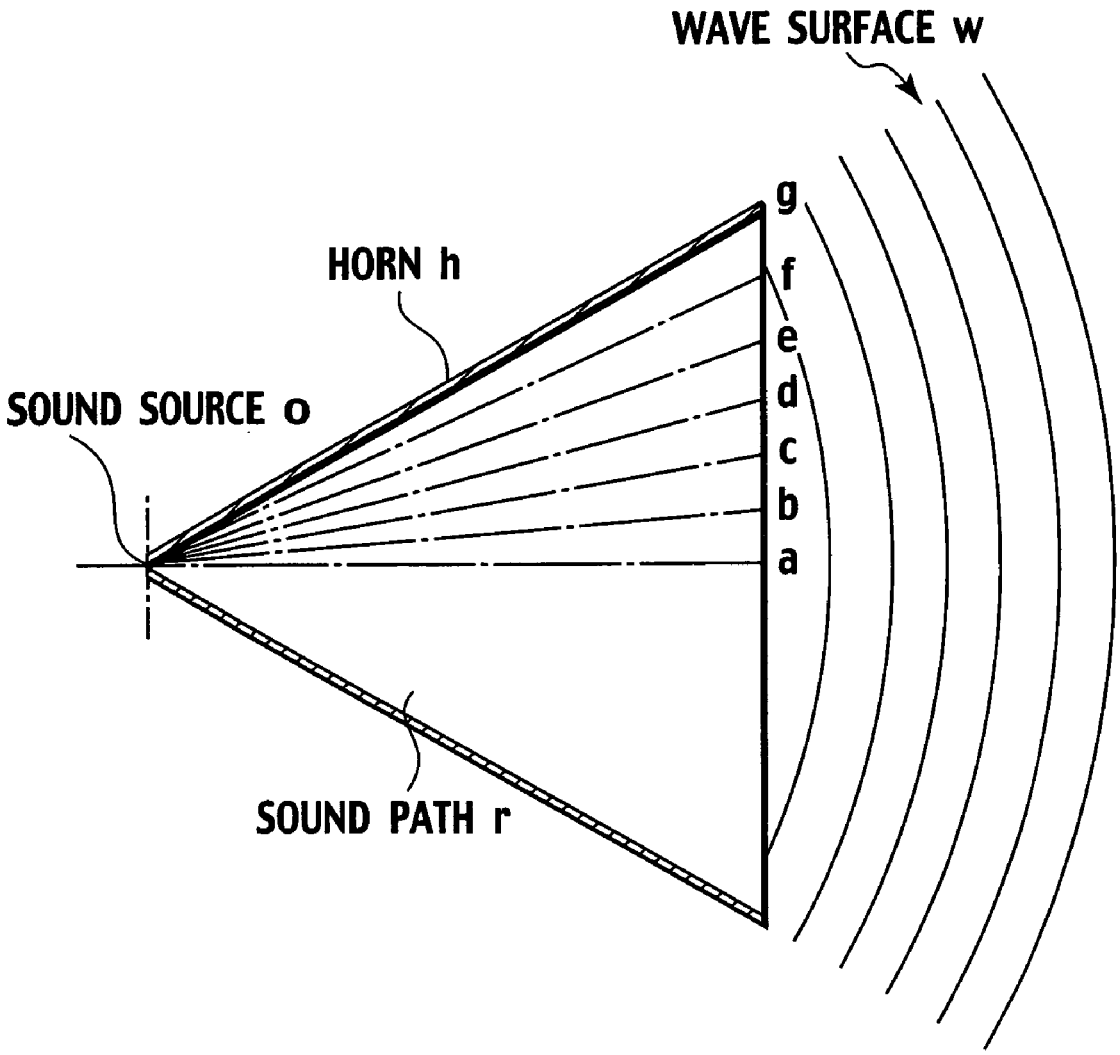
FIG. 1 PRIOR ART
FIG. 1 is a schematic view of a general horn speaker.
Figure 2A:
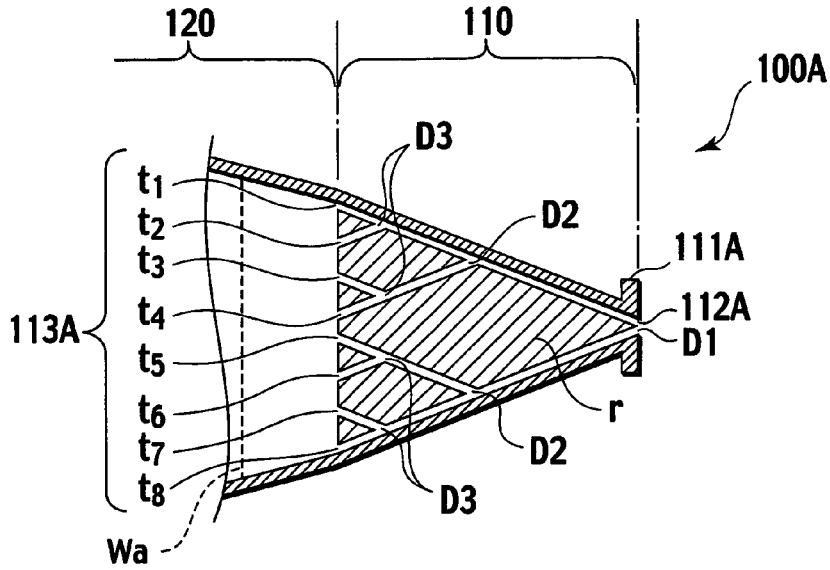
FIG. 2A PRIOR ART
FIGS. 2A to 2C are longitudinal sectional views of throat portions of horn speakers with various shapes of sound paths in the conventional sound wave-guiding structures for a speaker system.
Figure 2B:
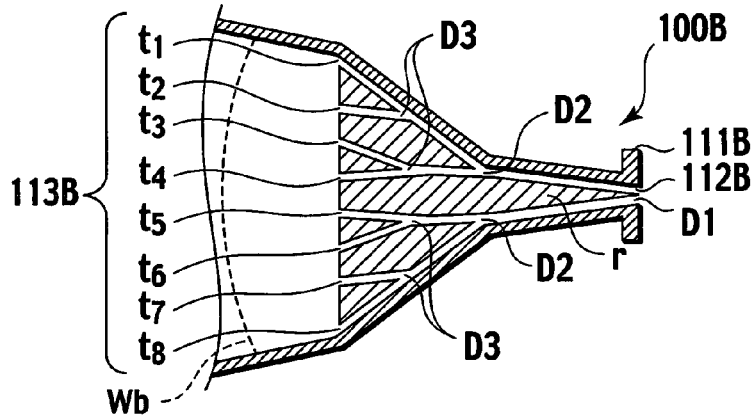
FIG. 2B PRIOR ART
Figure 2C:
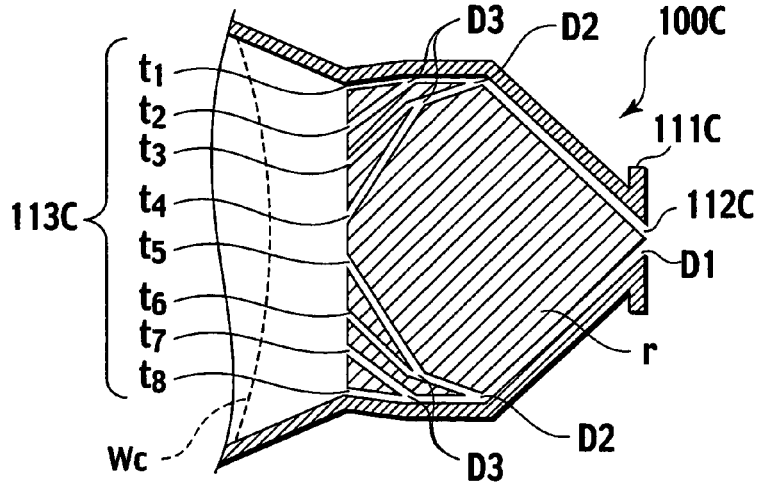
FIG. 2C PRIOR ART

In the sound path 13*g* of the sound-wave path-length correcting throat portion 13, the branch path structures with a plurality of stages as shown in FIGS. 2A to 2C are not formed. As described below, when the sound waves output from the speaker 11 are emitted from the rectangular outlet opening 13*b* formed at the top end of the sound-wave path-length correcting throat portion 13, the sound-wave path-length is corrected in the sound path 13*g* of the sound-wave path-length correcting throat portion 13 so that the wave surface in the same phase of the sound wave emitted from the rectangular outlet opening 13*b* is made to become any of a flat rectangular plane-like shape, a convex curve-like shape, and a concave curve-like shape, with respect to the emission direction of the sound wave.

The left side surface 13*c* of the sound-wave path-length correcting throat portion 13 is made to become a concave curved surface that is concaved towards the inside along the longitudinal direction of the rectangular outlet opening 13*b*. The right side surface 13*d* of the sound-wave path-length correcting throat portion 13 is made to become a convex curved surface that is convexed towards the outside along the longitudinal direction of the rectangular outlet opening 13*b*. With these shapes, the path-length of the sound wave emitted from the speaker 11 is corrected properly in the sound path 13*g*.

Figures 6A, 6B, 6C, 6D, 6E, 6F:
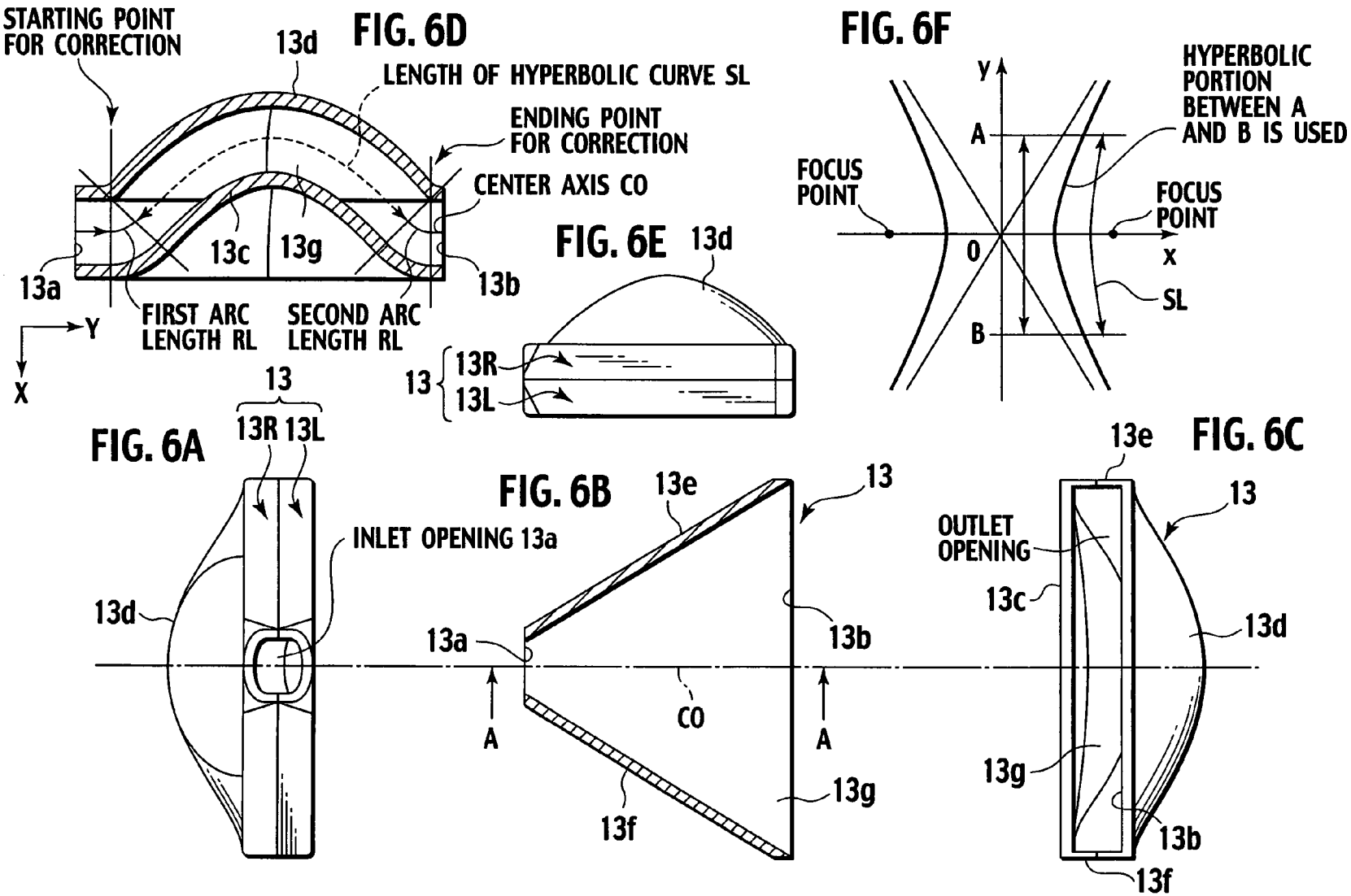
FIGS. 6A to 6F are a rear view, a longitudinal sectional view, a front view, an A-A sectional view, a top view, and a view illustrating an operating range of a hyperbolic curve that illustrate the sound-wave path-length correcting throat portion in the sound-wave path-length correcting structure for a speaker system according to the embodiment of the present invention.

The condition, when sectioning in the A-A direction along the center axis CO in the sound path 13*g* of the sound-wave path-length correcting throat portion 13 shown in FIG. 6B, is shown in FIG. 6D. In FIG. 6D, the center axis CO, which connects the center of the inlet opening 13*a* that opens at the back end side of the sound path 13*g* of the sound-wave path-length correcting throat portion 13 and the center of the outlet opening 13*b* that is opened rectangular at the top end side, is the reference axis of the sound-wave path-length to design the sound-wave path-length with respect to the sound wave that passes through the inside of the sound path 13*g*. A design basis sound-wave path-length is previously calculated in the following, with respect to the sound-wave path-length correction path from the starting point for correcting the sound-wave path-length that is set in the side of the inlet opening 13*a* to the ending point for correcting the sound-wave path-length that is set in the side of the outlet opening 13*b* through the center axis CO.

The starting point for correcting the sound-wave path-length that is set in the side of the inlet opening 13*a* and the ending point for correcting the sound-wave path-length that is set in the side of the outlet opening 13*b* of the sound-wave path-length correction path that passes on the center axis CO are connected smoothly curved-like with a first arc, a predetermined function curve, and a second arc in the sound path 13*g* of the sound-wave path-length correcting throat portion 13. The length of the curve between the starting point and the ending point for correcting the sound-wave path-length is previously calculated as the design basis sound-wave path-length.

In the embodiment, a hyperbolic curve is applied as the predetermined function curve. However, the predetermined function curve is not limited to the hyperbolic curve, which may be a sine curve, a cosine curve, a circular arc curve, a parabolic curve, an elliptic curve, a clothoid curve, a cycloid curve, a curve of the second or higher order, a common logarithm curve, a natural logarithm curve, a catenary curve, or the like.

Here, the design basis sound-wave path-length AL of the sound-wave path-length correction path that passes on the center axis CO can be calculated according to Eq. 1, $$AL=2\times RL+SL \qquad \text{Eq. 1}$$

where RL denotes the length of the first arc (=the length of the second arc) and SL denotes the length of the hyperbolic curve.

When x, y coordinate axes are set as shown in FIG. 6F, the hyperbolic curve can be expressed by the Eq. 2.

$$\frac{x^2}{a^2}-\frac{y^2}{b^2}=1 \qquad \text{Eq. 2}$$

In FIG. 6F, two focus points of the curve are points equally distant from the origin each other on the x-axis, and the y-axis is perpendicular to the x-axis and passes the origin.

Deforming Eq. 2 leads to Eq. 3.

$$f(y)=a\sqrt{\left(\frac{y}{b}\right)^2+1} \qquad \text{Eq. 3}$$

Here, the length SL of the hyperbolic curve is determined by Eq. 4, $$SL=\int_B^A\sqrt{1+f'^2(y)}\,dy \qquad \text{Eq. 4}$$

where A is a maximum value of y and B is a minimum value of y.

In FIG. 6F, the maximum value A is a positive value on the y-axis and the minimum value B is a negative value on the y-axis.

Further, when the length SL of the hyperbolic curve is not determined by Eq. 4, the approximate value IL may be determined by Eq. 5 as the length SL of the hyperbolic curve, $$SL\approx IL=h\times\left\{\frac{F(A)+F(B)}{2}+\sum_{i=1}^{n-1}Fi\right\} \qquad \text{Eq. 5}$$

where IL is an approximate value for SL, h is a width per piece when a section between A and B is divided into n pieces, and $F(y)=\sqrt{1+f^2(y)}$.

In particular, the approximate value IL is determined by dividing a section between the maximum value A and the minimum value B shown in FIG. 6F at even intervals into a plurality of pieces (n pieces) and calculating a width h of one piece, and then substituting the width h of one piece for Eq. 5.

Figure 7:
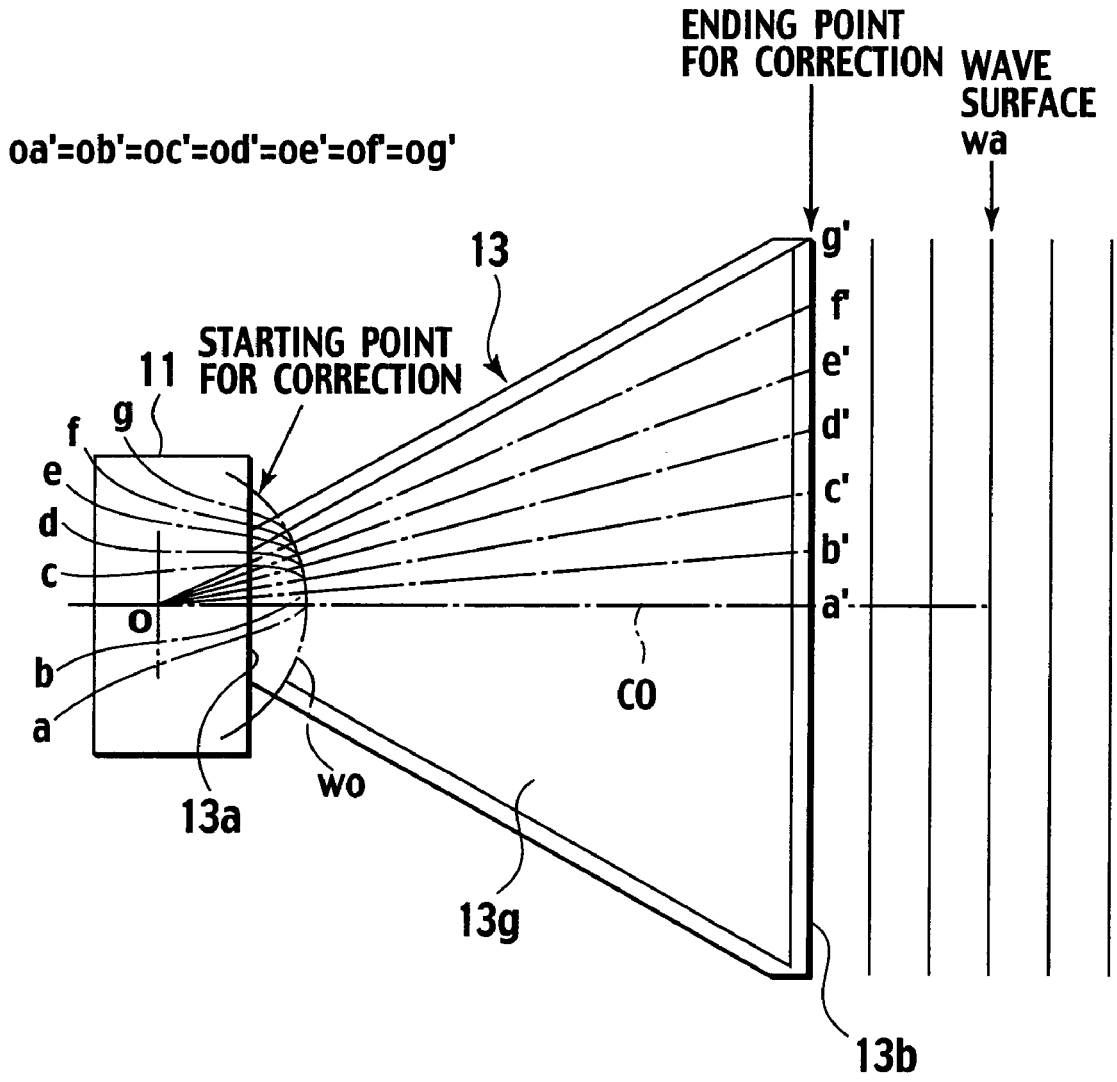
FIG. 7 is a schematic view illustrating the sound-wave path-length correction of a plurality of sound-wave path-length correction paths that are set in the sound path of sound-wave path-length correcting throat portion such that the wave surface of the sound wave emitted from the sound-wave path-length correcting throat portion to a loudspeaker horn portion side has a rectangular plane-like shape.
Figure 8:
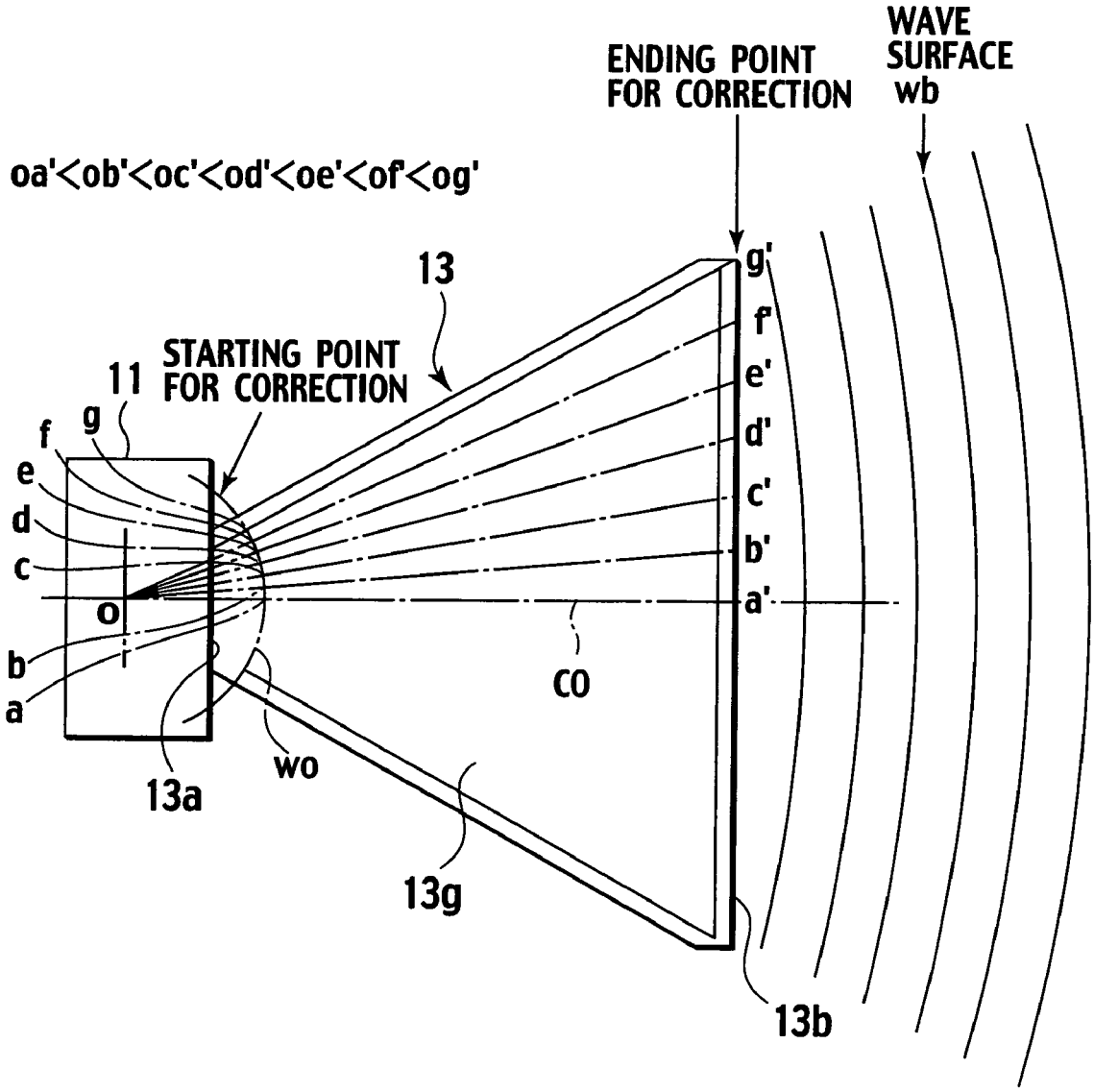
FIG. 8 is a schematic view illustrating the sound-wave path-length correction of a plurality of sound-wave path-length correction paths that are set in the sound path of sound-wave path-length correcting throat portion such that the wave surface of the sound wave emitted from the sound-wave path-length correcting throat portion to a loudspeaker horn portion side has a convex curve-like shape.
Figure 9:
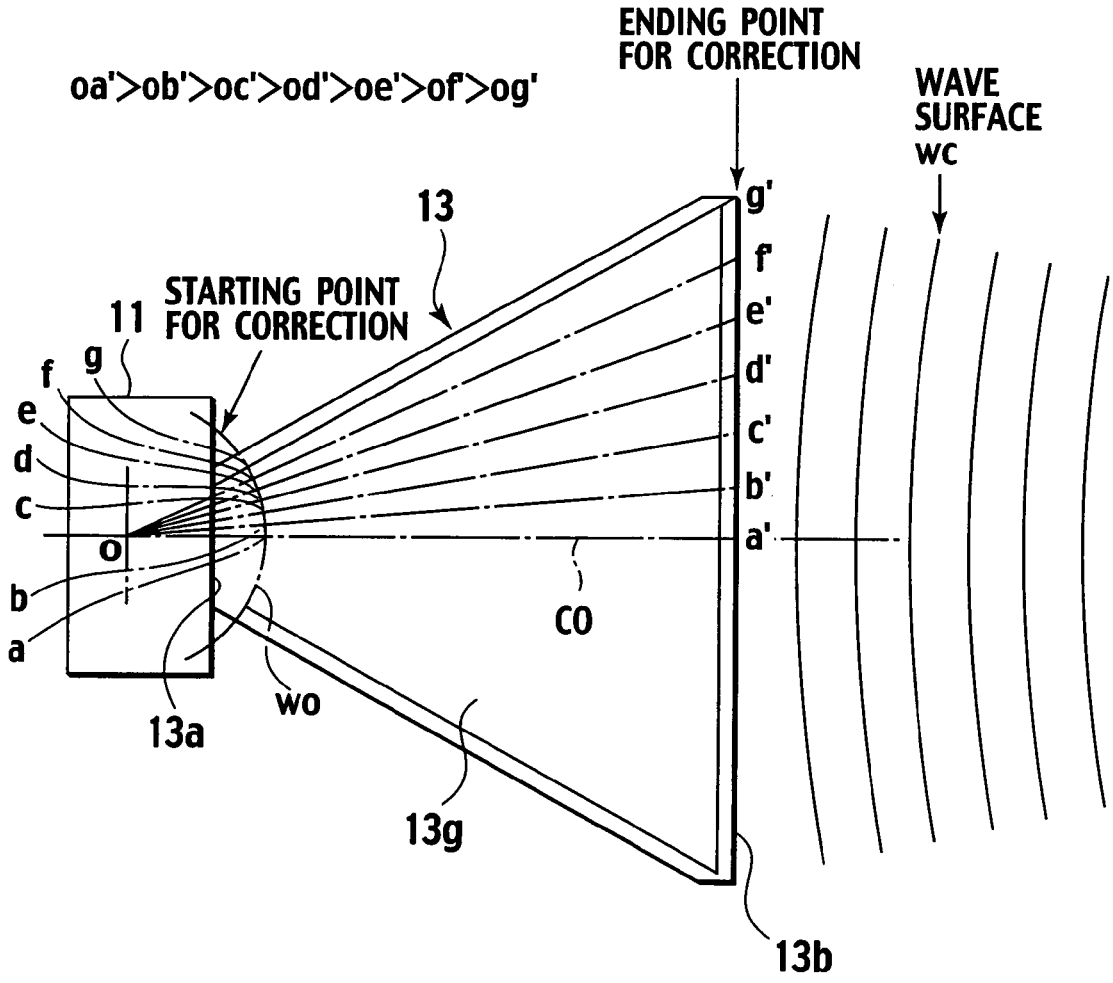
FIG. 9 is a schematic view illustrating the sound-wave path correction of a plurality of sound-wave path-length correction paths that are set in the sound path of sound-wave path-length correcting throat portion such that the wave surface of the sound wave emitted from the sound-wave path-length correcting throat portion to a loudspeaker horn portion side has a concave curve-like shape.

The design basis sound-wave path-length AL of the sound-wave path-length correction path that passes on the center axis CO is calculated by adding the first arc length RL, the second arc length RL, and the length SL of the hyperbolic curve. As described-below, the design basis sound-wave path-length AL is set as a base, thus, the lengths of a plurality of sound-wave path-lengths that are to be set in the sound path 13*g* of the sound-wave path-length correcting throat portion 13 as shown in FIGS. 7 to 9, are calculated.

Based on the design basis sound-wave path-length AL, each example of correcting sound-wave path-lengths with respect to a plurality of the sound-wave path-length correction paths along the left side surface 13C and the right side surface 13*d* will be described below, referring to FIGS. 7 to 12C, without providing a plurality stages of partition walls in the sound path 13*g* of the sound-wave path-length correcting throat portion 13.

In FIGS. 7 to 12C, the lines oa, ob, oc, od, oe, of and og indicate a plurality of sound-wave paths from the sound source o to output ends (correction starting points) from which the wave surface wo of the sound wave emitted from the sound source o are output concentric circularly. The lines oa', ob', oc', od', oe', of' and og' indicate a plurality of sound-wave path-length correction paths that are corrected to the sound wave emitted from the sound source o in the sound path 13*g* of the sound-wave path-length correcting throat portion 13.

When the sound-wave path-length correction path that passes on the center axis CO in the sound path 13*g* of the sound-wave path-length correcting throat portion 13 is formed by connecting smoothly with the first arc, a predetermined function curve, and the second arc, one of various function curves is used for the predetermined function curve and thus, a specific calculation process is not provided. Accordingly, the sound-wave path-length correction path can be designed easily and the length SL of the function curve for the sound-wave path-length correction path can be calculated easily. Based on the sound-wave path-length correction path determined in this manner, the lengths of a plurality of sound-wave paths to be set in the sound path 13*g* of the sound-wave path-length correcting throat portion 13 can be formed easily.

Moreover, the sound path 13*g* of the sound-wave path-length correcting throat portion 13 has a vertically symmetrical shape centering on the center axis CO. Therefore, for a plurality of sound-wave path-length correction paths oa', ob', oc', oe', of' and og', only the upper sides are shown in FIGS. 7 to 12C.

Figure 10A:
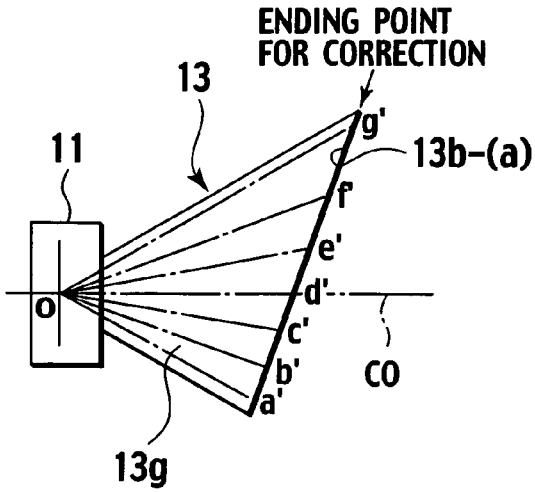
FIGS. 10A to 10E are schematic views illustrating shapes of surfaces including rim portions of outlet openings of sound-wave path-length correcting throat portions.
Figure 10D:
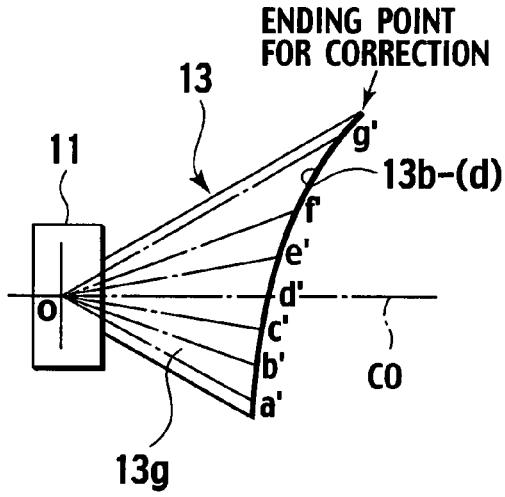
Figure 10B:
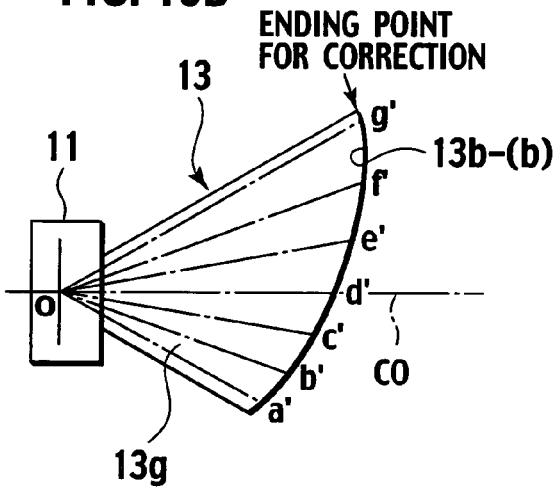
Figure 10E:
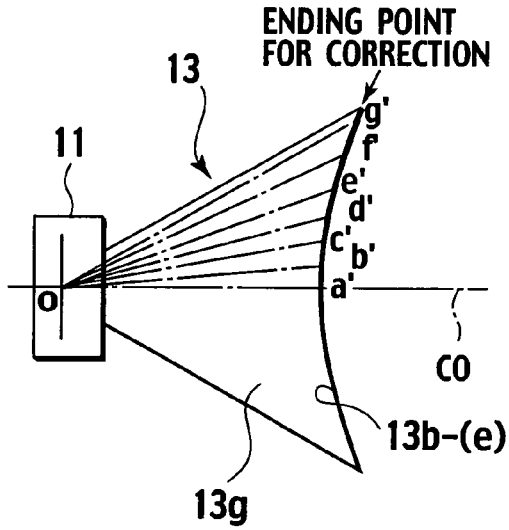
Figure 10C:
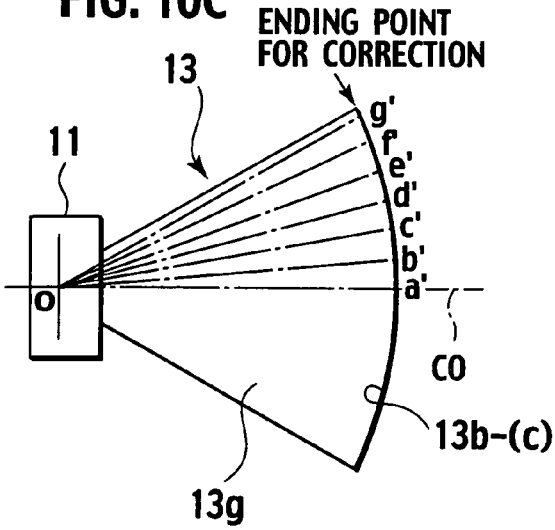

FIGS. 10A, 10B and 10D show examples that the sound paths 13*g* of the sound-wave path-length correcting throat portions 13 has vertically asymmetrical shapes centering on the center axes CO, respectively. FIGS. 10C and 10E show each example in which the sound path 13*g* of the sound-wave path-length correcting throat portion 13 has a vertically symmetrical shape centering on the center axis CO.

In a plurality of the sound-wave path-length correction paths oa', ob', oc', od', oe', of' and og' that are set in the sound path 13*g* of the sound-wave path-length correcting throat portion 13, each of the sound-wave path-lengths is formed based on the design basis sound-wave path-length AL that is obtained by connecting the first arc, a predetermined function curve, and the second arc, in accordance with the conditions indicated in FIGS. 7 to 9. However, in FIGS. 7 to 12C, for convenience of illustration, the sound-wave path-length correction paths oa', ob', oc', od', oe', of' and og' are illustrated in a linear manner.

The sound-wave path correcting throat portion 13 has a plurality of the sound-wave path-length correction paths oa', ob', oc', od', oe', of' and og' that are formed along the left side surface 13*c* and the right side surface 13*d* in the sound path 13*g*. Points a', b', c', d', e', f' and g' are lined along the longitudinal direction of the outlet opening 13*b* from the center of the outlet opening 13*b* to the upper side. When a plurality of the sound-wave paths oa', ob', oc', od', oe', of' and og' are corrected based on the design basis sound-wave path-length AL of the sound-wave path-length correction path that passes on the center axis CO, the output ends of the plurality of the sound-wave paths oa', ob', oc', od', oe', of' and og' that are emitted in a concentric circle shape from the sound source o are set as the starting points for correcting the sound-wave path-length, and also the output opening 13*b* of the sound-wave path-length correcting throat portion 13 is set as the ending point for correcting the sound-wave path-length.

In the example shown in FIG. 7, a plurality of sound-wave path-length correction paths oa', ob', oc', od', oe', of' and og' are set along the longitudinal direction of the outlet opening 13*b* in the sound path 13*g* of the sound-wave path-length correcting throat portion 13. Here, in the sound-wave path-length correction path oa' that passes on the center axis CO connecting the center of the inlet opening 13*a* and the center in the longitudinal direction of the outlet opening 13*b*, the starting point for correcting the sound-wave path-length that is set in the side of the inlet opening 13*a* and the ending point for correcting the sound-wave path-length that is set in the side of outlet opening 13*b* are connected with the first arc, a predetermined function curve, and the second arc. The length of the curve between the starting point for correcting the sound-wave path-length and the ending point for correcting the sound-wave path-length in the sound-wave path-length correction path oa' is calculated as the design basis sound-wave path-length AL and each of sound-wave path-lengths of a plurality of sound-wave path-length correction paths oa', ob', oc', od', oe', of' and og' is set equivalent to the design basis sound-wave path-length AL. In other words, the sound path 13*g* is formed so that the sound-wave path-lengths are equivalent to each other (oa'=ob'=oc'=od'=oe'=of'=og'). Thus, the wave surface wa in the same phase of the sound wave that is emitted from the outlet opening 13*b* of the sound path 13*g* of the sound-wave path-length correcting throat portion 13 to the side of the loudspeaker horn portion 14 has a flat rectangular plane-like shape with respect to the emission direction of the sound wave.

In the example shown in FIG. 8, a plurality of the sound-wave path-length correction paths oa', ob', oc', od', oe', of' and og' are set along the longitudinal direction of the outlet opening 13*b* in the sound path 13*g* of the sound-wave path-length correcting throat portion 13. Here, in the sound-wave path-length correction path oa' that passes on the center axis CO connecting the center of the inlet opening 13*a* and the center in the longitudinal direction of the outlet opening 13*b*, the starting point for correcting the sound-wave path-length that is set in the side of the inlet opening 13*a* and the ending point for correcting the sound-wave path-length that is set in the side of outlet opening 13*b* are connected with the first arc, a predetermined function curve, and the second arc. The length of the curve between the starting point for correcting the sound-wave path-length and the ending point for correcting the sound-wave path-length in the sound-wave path-length correction path oa' is calculated as the design basis sound-wave path-length AL and each of the sound-wave path-lengths of a plurality of sound-wave path-length correction paths oa', ob', oc', od', oe', of' and og' is set at a length that becomes gradually longer than the design basis sound-wave path-length AL, as the sound-wave path-length advances to the outer circumference in the longitudinal direction of the outlet opening 13*b*. In other words, the sound path 13*g* is formed so that the sound-wave path-length becomes gradually longer (oa'<ob'<oc'<od'<oe'<of'<og'), as the sound-wave path-length advances in the longitudinal direction from the center of the outlet opening 13*b*. Thus, the wave surface wb in the same phase of the sound wave that is emitted from the outlet opening 13*b* of the sound path 13*g* of the sound-wave path-length correcting throat portion 13 to the side of the loudspeaker horn portion 14 has a convex curve-like shape with respect to the emission direction of the sound wave.

In the example shown in FIG. 9, a plurality of sound-wave path-length correction paths oa', ob', oc', od', oe', of' and og' are set along the longitudinal direction of the outlet opening 13*b* in the sound path 13*g* of the sound-wave path-length correcting throat portion 13. Here, in the sound-wave path-length correction path oa' that passes on the center axis CO connecting the center of the inlet opening 13*a* and the center in the longitudinal direction of the outlet opening 13*b*, the starting point for correcting the sound-wave path-length that is set in the side of the inlet opening 13*a* and the ending point for correcting the sound-wave path-length that is set in the side of outlet opening 13*b* are connected with the first arc, a predetermined function curve, and the second arc. The length of the curve between the starting point for correcting the sound-wave path-length and the ending point for correcting the sound-wave path-length in the sound-wave path-length correction path oa' is calculated as the design basis sound-wave path-length AL and each of sound-wave path-lengths of a plurality of sound-wave path-length correction paths oa', ob', oc', od', oe', of' and og' is set at a length that becomes gradually shorter than the design basis sound-wave path-length AL, as the sound-wave path-length advances to the outer circumference in the longitudinal direction of the outlet opening 13*b*. In other words, the sound path 13*g* is formed so that the sound-wave path-length becomes gradually shorter (oa'>ob'>oc'>od'>oe'>of'>og'), as the sound-wave path-length advances in the longitudinal direction from the center of the outlet opening 13*b*. Thus, the wave surface wc in the same phase of the sound wave that is emitted from the outlet opening 13*b* of the sound path 13*g* of the sound-wave path-length correcting throat portion 13 to the side of the loudspeaker horn portion 14 has a concave curve-like shape with respect to the emission direction of the sound wave.

The above is summarized in the following. In accordance with the sound-wave path-length correcting throat portion 13 shown in FIGS. 7 to 9, the wave surfaces wa, wb and wc of the sound waves that are emitted from the outlet opening 13*b* of the sound path 13*g* of the sound-wave path-length correcting throat portion 13 to the side of the loudspeaker horn portion 14 have a flat rectangular plane-like shape, a convex curve-like shape, and a concave curve-like shape with respect to the emission direction of sound wave, respectively. Therefore, even when the wavelengths of the sound waves are short (high frequency), interference of the sound waves will not occur. Thus, the output sound waves have an equal sound pressure, which enables to provide the sound-wave path-length correcting structure for a speaker system with a good performance.

In accordance with the respective sound-wave path-length correcting throat portions 13 shown in FIGS. 7 to 9, the branch path structure with a plurality of stages is not formed in the sound path 13*g* of the sound-wave path-length correcting throat portion 13, which facilitates production of the sound path 13*g* of the sound-wave path-length correcting throat portion 13. Accordingly, even when the sound-wave path-length correcting throat portion 13 is large-sized, the inside of the sound path 13*g* is not complex, and also, even when the sound-wave path-length correcting throat portion 13 is small-sized, it is unlikely that formation of the sound path 13*g* becomes difficult due to space.

The example shown in FIG. 10A is formed so that a surface including the rim portion of the outlet opening 13*b*-(*a*) to be the ending point for correcting the sound-wave path-length has a plane-like shape. The example shown in FIG. 10B is formed so that a surface including the rim portion of the outlet opening 13*b*-(*b*) to be the ending point for correcting the sound-wave path-length has a convex curve-like shape. The example shown in FIG. 10C is formed so that a surface including the rim portion of the outlet opening 13*b*-(*c*) to be the ending point for correcting the sound-wave path-length has a convex circular arc surface-like shape. The example shown in FIG. 10D is formed so that a surface including the rim portion of the outlet opening 13*b*-(*d*) to be the ending point for correcting the sound-wave path-length has a concave curve-like shape. The example shown in FIG. 10E is formed so that a surface including the rim portion of the outlet opening 13*b*-(*e*) has a concave circular arc surface-like shape. In this manner, in the embodiment, the surfaces including the rim portions of the outlet openings of the sound-wave path-length correcting throat portion 13 may be formed to any of the shapes shown in FIGS. 10A to 10E.

Figure 11A:
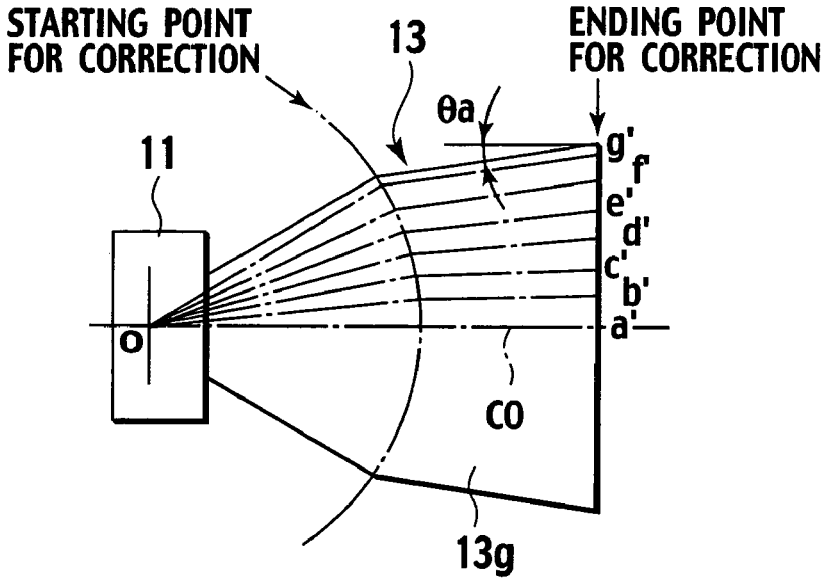
FIGS. 11A to 11C are schematic views illustrating sound wave emission angles of sound-wave path-length correction paths of the outermost sides in sound paths of sound-wave path-length correcting throat portions.
Figure 11B:
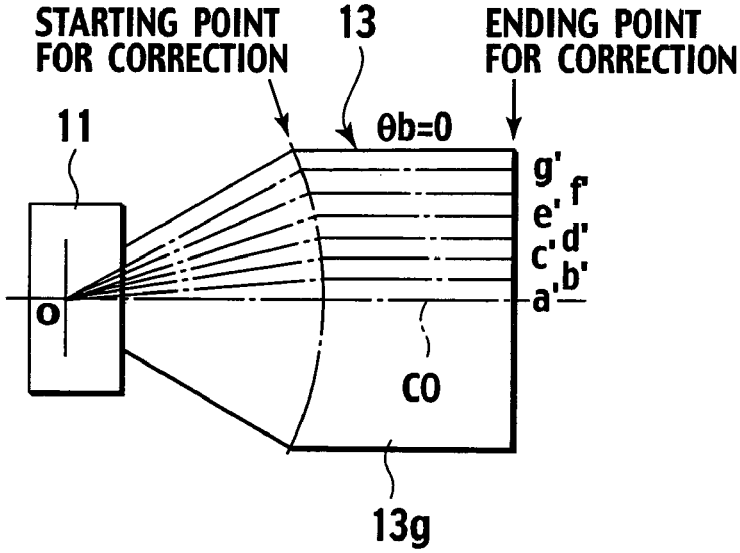
Figure 11C:
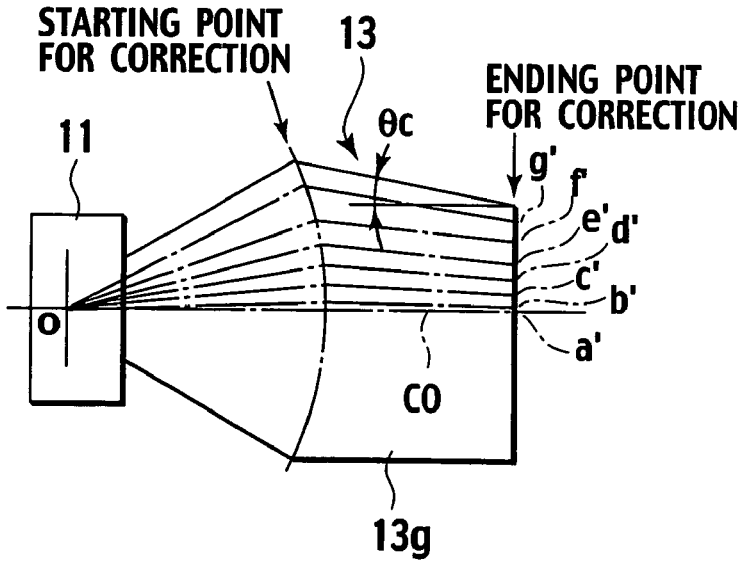

In the example shown in FIG. 11A, a plurality of the sound-wave path-length correction paths oa', ob', oc', od', oe', of' and og' are vertically symmetrical centering on the center axis CO and also, is set so that the sound-wave emission angle θa of the outermost sound-wave path-length correction path og' in the sound path 13*g* widens towards the side of the loudspeaker horn portion 14. That is, an angle between the sound-wave path-length correction path og' and the output opening 13*b* is less than 90 degree. In the example shown in FIG. 11B, a plurality of the sound-wave path-length correction paths oa', ob', oc', od', oe', of', and og' are vertically symmetrical centering on the center axis CO and also, is set so that the sound-wave emission angle θb (=0) of the outermost sound-wave path-length correction path og' in the sound path 13*g* is in parallel with the center axis OC. That is, an angle between the sound-wave path-length correction path og' and the output opening 13*b* is 90 degree. In the example shown in FIG. 11C, a plurality of the sound-wave path-length correction paths oa', ob', oc', od', oe', of', and og' are vertically asymmetrical centering on the center axis CO and also, is set so that the sound-wave emission angle θc of the outermost sound-wave path-length correction path og' in the sound path 13*g* narrows towards the side of the loudspeaker horn portion 14. That is, an angle between the sound-wave path-length correction path og' and the output opening 13*b* is more than 90 degree. In this manner, in the embodiment, the sound-wave emission angles of the outermost sound-wave path-length correction path og' in the sound path 13*g* may be set to proper angles.

Figure 12A:
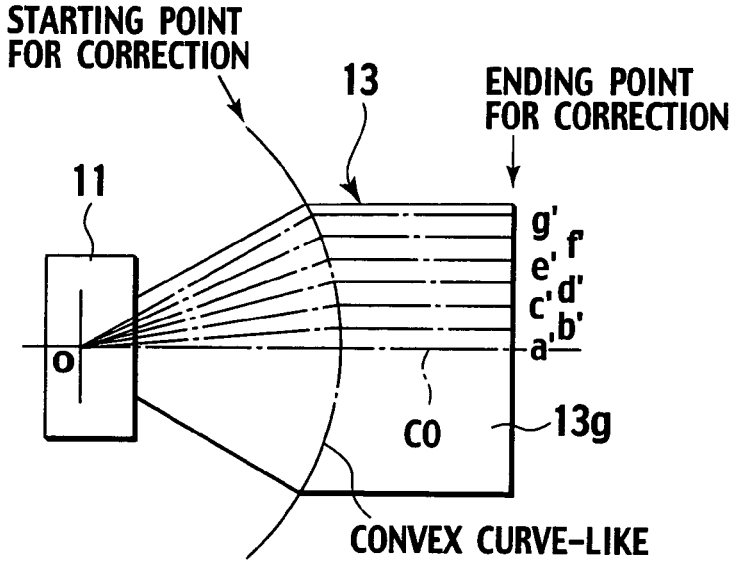
FIGS. 12A to 12C are schematic views illustrating starting points of sound-wave path-length correction when correcting sound-wave path-lengths of a plurality of sound-wave path-length correction paths that are set in sound paths of sound-wave path-length correcting throat portions.
Figure 12B:
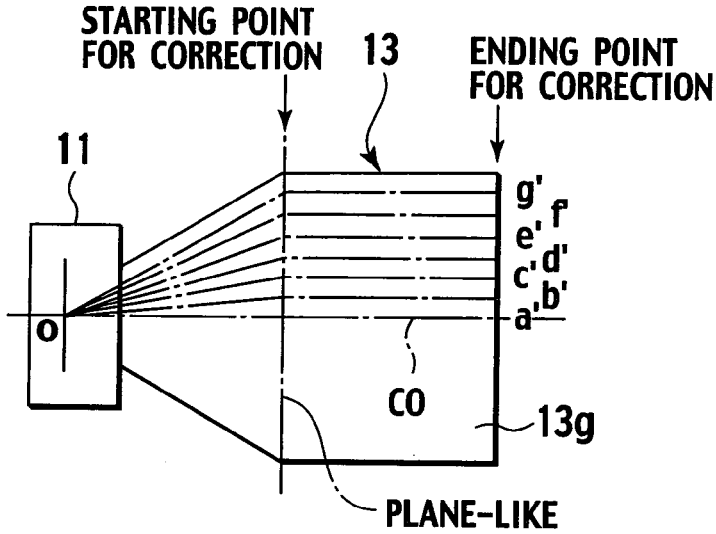
Figure 12C:
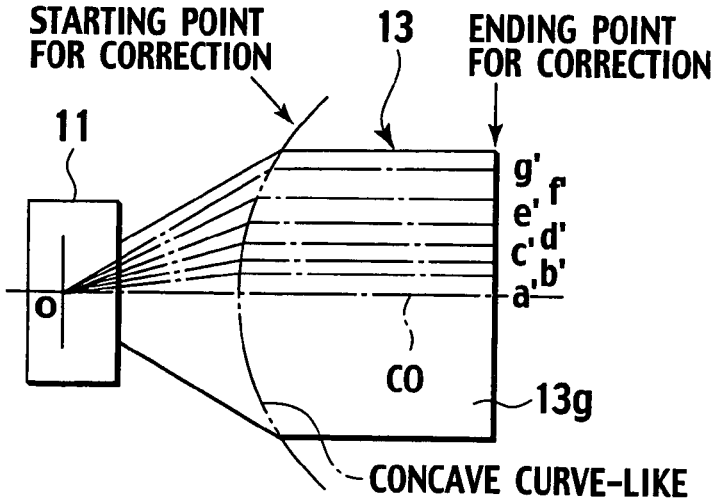

In the example shown in FIG. 12A, the starting points for correcting the sound-wave path-length that starts correcting each of sound-wave path-lengths of a plurality of sound-wave path-length correction paths oa', ob', oc', od', oe', of' and og' are set convex curve-like. In the example shown in FIG. 12B, the starting points for correcting the sound-wave path-length that starts correcting each of sound-wave path-lengths of a plurality of sound-wave path-length correction paths oa', ob', oc', od', oe', of' and og' are set plane-like. In the example shown in FIG. 12C, the starting points for correcting the sound-wave path-length that starts correcting each of sound-wave path-lengths of a plurality of sound-wave path-length correction paths oa', ob', oc', od', oe', of' and og' are set concave curve-like. In this manner, in the embodiment, the starting points for correcting the sound-wave path-length that starts correcting each of sound-wave path-lengths of a plurality of sound-wave path-length correction paths oa', ob', oc', od', oe', of' and og' are set to any of the shapes in FIGS. 12A to 12C.

What is claimed is:

1. A sound-wave path-length correcting structure for a speaker system, comprising:

a sound source for outputting sound waves; and a horn having a sound-wave path-length correcting throat portion for correcting a sound-wave path-length of a sound wave input from an inlet opening thereof connected to the sound source in a sound path and emitting the sound wave from a rectangular outlet opening, and a loudspeaker horn portion for amplifying the sound wave emitted from the outlet opening, wherein:

the sound path is defined by a first side surface with a concave curve and a second side surface with a convex curve which are positioned in the longitudinal direction of the outlet opening and face each other with a space, and a third side surface and a fourth side surface which are positioned in the short direction of the outlet opening and face each other with a space;

the third side surface and the fourth side surface are formed such that the surfaces gradually widen towards the outside as the surfaces advance from the inlet opening to the outlet opening; and in the sound path, a center axis connecting a center of the inlet opening and a center of the outlet opening is curved along the first side surface and the second side surface.

2. The sound-wave path-length correcting structure for a speaker system according to claim 1, wherein in the sound path, the wave surface of the sound wave emitted from the outlet opening toward the loudspeaker horn portion is made to have any of a flat rectangular shape, a convex curve shape, and a concave curve shape, with respect to the emission direction of the sound wave.

3. The sound-wave path-length correcting structure for a speaker system according to claim 1, wherein:

in the sound-wave path-length correcting throat portion, a plurality of sound-wave path-length correction paths are set in the sound path along the longitudinal direction of the outlet opening;

a sound-wave path-length correction oath is continuously connected to an adjacent sound-wave path-length correction path;

in a sound-wave path-length correction path that passes a center axis connecting the center of the inlet opening and the center in the longitudinal direction of the outlet opening, a starting point for correcting the sound-wave path-length set in the inlet opening side and an ending point for correcting the sound-wave path-length set in the outlet opening side are connected each other with a first arc, a predetermined function curve, and a second arc; and when a length of a curve between the starting point for correcting the sound-wave path-length and the ending point for correcting the sound-wave path-length in the sound-wave path-length correction path is set to a design basis sound-wave path-length, sound-wave path-lengths of the plurality of sound-wave path-length correction paths are equivalent to the design basis sound-wave path-length.

4. The sound-wave path-length correcting structure for a speaker system according to claim 1, wherein:

in the sound-wave path-length correcting throat portion, a plurality of sound-wave path-length correction paths are set in the sound path along the longitudinal direction of the outlet opening;

a sound-wave path-length correction path is continuously connected to an adjacent sound-wave path-length correction path;

in a sound-wave path-length correction path that passes a center axis connecting the center of the inlet opening and the center in the longitudinal direction of the outlet opening, a starting point for correcting the sound-wave path-length set in the inlet opening side and an ending point for correcting the sound-wave path-length set in the outlet opening side are connected each other with a first arc, a predetermined function curve, and a second arc; and when a length of a curve between the starting point for correcting the sound-wave path-length and the ending point for correcting the sound-wave path-length in the sound-wave path-length correction path is set to a design basis sound-wave path-length, sound-wave path-lengths of the plurality of sound-wave path-length correction paths become gradually longer than the design basis sound-wave path-length, as the sound-wave path-lengths advance to the outer circumference in the longitudinal direction of the outlet opening.

5. The sound-wave path-length correcting structure for a speaker system according to claim 1, wherein:

in the sound-wave path-length correcting throat portion, a plurality of sound-wave path-length correction paths are set in the sound path along the longitudinal direction of the outlet opening;

a sound-wave path-length correction path is continuously connected to an adjacent sound-wave path-length correction path;

in a sound-wave path-length correction path that passes on the center axis connecting the center of the inlet opening and the center in the longitudinal direction of the outlet opening, a starting point for correcting the sound-wave path-length that is set in the inlet opening side and an ending point for correcting the sound-wave path-length that is set in the outlet opening side are connected each other with a first arc, a predetermined function curve, and a second arc; and when a length of a curve between the starting point for correcting the sound-wave path-length and the ending point for correcting the sound-wave path-length in the sound-wave path-length correction path is set to a design basis sound-wave path-length, sound-wave path-lengths of the plurality of sound-wave path-length correction paths become gradually shorter than the design basis sound-wave path-length, as the sound-wave path-lengths advance to the outer circumference in the longitudinal direction of the outlet opening.

6. The sound-wave path-length correcting structure for a speaker system according to claim 3, wherein the predetermined function curve is any of a hyperbolic curve, a sine curve, a cosine curve, a circular arc curve, a parabolic curve, an elliptic curve, a clothoid curve, a cycloid curve, a curve of the second or higher order, a common logarithm curve, a natural logarithm curve, and a catenary curve.

7. The sound-wave path-length correcting structure for a speaker system according to claim 3, wherein a surface including a rim portion of the outlet opening is formed to be plane-like, convex curve-like, or concave curve-like.

8. The sound-wave path-length correcting structure for a speaker system according to claim 3, wherein starting points for correcting the sound-wave path-length are set convex curve-like, plane-like, or concave curve-like.

9. The sound-wave path-length correcting structure for a speaker system according to claim 4, wherein the predetermined function curve is any of a hyperbolic curve, a sine curve, a cosine curve, a circular arc curve, a parabolic curve, an elliptic curve, a clothoid curve, a cycloid curve, a curve of the second or higher order, a common logarithm curve, a natural logarithm curve, and a catenary curve.

10. The sound-wave path-length correcting structure for a speaker system according to claim 4, wherein a surface including a rim portion of the outlet opening is formed to be plane-like, convex curve-like, or concave curve-like.

11. The sound-wave path-length correcting structure for a speaker system according to claim 4, wherein starting points for correcting the sound-wave path-length are set convex curve-like, plane-like, or concave curve-like.

12. The sound-wave path-length correcting structure for a speaker system according to claim 5, wherein the predetermined function curve is any of a hyperbolic curve, a sine curve, a cosine curve, a circular arc curve, a parabolic curve, an elliptic curve, a clothoid curve, a cycloid curve, a curve of the second or higher order, a common logarithm curve, a natural logarithm curve, and a catenary curve.

13. The sound-wave path-length correcting structure for a speaker system according to claim 5, wherein a surface including a rim portion of the outlet opening is formed to be plane-like, convex curve-like, or concave curve-like.

14. The sound-wave path-length correcting structure for a speaker system according to claim 5, wherein starting points for correcting the sound-wave path-length are set convex curve-like, plane-like, or concave curve-like.

15. A sound-wave path-length correcting structure for a speaker system, comprising:

a sound source for outputting sound waves; and a horn having a sound-wave path-length correcting throat portion for correcting a sound-wave path-length of a sound wave input from an inlet opening thereof connected to the sound source in a sound path and emitting the sound wave from a rectangular outlet opening, and a loudspeaker horn portion for amplifying the sound wave emitted from the outlet opening, wherein:

the sound path is defined by a first side surface with a concave curve and a second side surface with a convex curve which are positioned in the longitudinal direction of the outlet opening and face each other with a space, and a third side surface and a fourth side surface which are positioned in the short direction of the outlet opening and face each other with a space;

the third side surface and the fourth side surface are formed such that the surfaces gradually widen towards the outside as the surfaces advance from the inlet opening to the outlet opening;

in the sound path, a center axis connecting a center of the inlet opening and a center of the outlet opening is curved along the first side surface and the second side surface; and in the sound path, the wave surface in the same phase of the sound wave emitted from the outlet opening toward the loudspeaker horn portion is made to have any of a flat rectangular shape, a convex curve shape, and a concave curve shape, with respect to the emission direction of the sound wave.

* * * * *

UNITED STATES PATENT AND TRADEMARK OFFICE

CERTIFICATE OF CORRECTION

PATENT NO. : 7,631,724 B2
APPLICATION NO. : 12/081806
DATED : December 15, 2009
INVENTOR(S) : Masatake Onishi It is certified that error appears in the above-identified patent and that said Letters Patent is hereby corrected as shown below:

Column 13, Claim 3, Line 54
Please delete "oath"
and replace with -- path --

Signed and Sealed this

Ninth Day of February, 2010

David J. Kappos

David J. Kappos
*Director of the United States Patent and Trademark Office*